US007360662B2

(12) United States Patent
Montineri

(10) Patent No.: US 7,360,662 B2
(45) Date of Patent: Apr. 22, 2008

(54) TELESCOPIC BOOM ARM

(75) Inventor: Giampaolo Montineri, Corciano (IT)

(73) Assignee: CNH America LLC, New Holland, PA (US)

( * ) Notice: Subject to any disclaimer, the term of this patent is extended or adjusted under 35 U.S.C. 154(b) by 221 days.

(21) Appl. No.: 10/999,081

(22) Filed: Nov. 29, 2004

(65) Prior Publication Data

US 2005/0218101 A1 Oct. 6, 2005

(30) Foreign Application Priority Data

Nov. 28, 2003 (IT) ..... TO2003A0957

(51) Int. Cl.
*B66C 23/04* (2006.01)

(52) U.S. Cl. ..... 212/349

(58) Field of Classification Search ..... 212/349, 212/350

See application file for complete search history.

(56) References Cited

U.S. PATENT DOCUMENTS 3,623,501 A * 11/1971 Reimbold ..... 137/355.17
3,666,125 A * 5/1972 Gano et al. ..... 414/718
3,715,039 A * 2/1973 Kollmann et al. ..... 212/349
3,804,262 A * 4/1974 Wiencek et al. ..... 212/349
4,125,974 A * 11/1978 Kay et al. ..... 52/115
RE30,021 E 6/1979 Olson et al.
4,380,244 A * 4/1983 Caudill et al. ..... 137/355.16
4,506,480 A * 3/1985 Murrill et al. ..... 52/121
4,954,041 A * 9/1990 Dahlquist et al. ..... 414/718
5,494,397 A * 2/1996 Wilson ..... 414/728
5,718,345 A * 2/1998 Hade, Jr. ..... 212/349
5,924,837 A * 7/1999 Passmann ..... 414/718
6,244,450 B1 * 6/2001 Woodling ..... 212/349

* cited by examiner

*Primary Examiner*—Thomas J Brahan
(74) *Attorney, Agent, or Firm*—Patrick M. Sheldrake; John William Stader; Michael G. Harms

(57) ABSTRACT

A telescopic boom arm operable between a retracted position and an extended position includes an elongate first boom section, an elongate second boom section, and a flexible hydraulic line.

6 Claims, 3 Drawing Sheets

TELESCOPIC BOOM ARM

The present invention relates to a telescopic boom arm and is particularly concerned with the routing of flexible hydraulic lines in the boom arm.

It is known, for example from U.S. Reissue Pat. No. 30,021, to mount a hydraulically operated telescopically collapsible boom arm on a self-propelled low profile material handling vehicle, such a vehicle being commonly referred to as a telehandler. In a telehandler, the boom arm extends lengthways of the vehicle and is mounted to one side of the centreline of the vehicle, the cab being positioned on the opposite side. The boom arm is transported in a horizontal position, enabling the driver sitting in the cab to look over it. At its rear end, the boom arm is pivoted to the body of the vehicle so that it can be raised from its transport position to a near-vertical position by means of a hydraulic cylinder acting between the first section of the boom arm and the vehicle body.

The boom arm has several hollow sections or progressively smaller cross sections which are located one within the other when the boom arm is retracted to its minimum length. The sections can be moved apart to extend the boom arm by means of hydraulic cylinders arranged within the boom arm. The free end of the boom arm can carry a variety of implements or devices, for example a fork assembly as described in U.S.-RE. Pat. No. 30,021, that may themselves also be hydraulically powered.

There is therefore a requirement to connect flexible hydraulic lines to moving sections of the boom arm, these hydraulic lines being required not only to enable the boom arm itself to be extended and retracted but also to power the devices or implements carried by the boom arm at its free end.

It has hitherto been necessary to pass flexible hydraulic lines up the center of the boom arm and to provide some convenient way of storing the lines outside the boom arm when the boom arm was in its retracted condition. The lines risked becoming entangled with one another and they were also subjected to wear as they rubbed against the inner surfaces of the different sections as the boom arm was extended and retracted.

With a view to mitigating the foregoing disadvantages, the preferred embodiment provides a telescopic boom arm comprising a plurality of elongate sections of progressively decreasing cross section received and guided one within the other, wherein a flexible hydraulic line is connected to one of the inner sections of the boom arm and an elongate channel is defined between two of the sections of the boom arm to accommodate the flexible hydraulic line when the boom arm is in its fully retracted condition.

The sections will herein be identified by their position along the extended boom arm, the first section being the one pivoted on the vehicle, the second being the next smaller section and so on. To distinguish them from one another, the ends of the different sections of the boom arm will herein be referred to as the rear end and the front end, respectively. The rear end of a section is the one nearer the end of the boom arm pivoted on the vehicle and the front end is the one nearer the free end of the boom arm.

Hitherto, all the flexible hydraulic lines needed to pass through the rear end of the first section and to be stored outside the boom arm when it was retracted. In the present invention, on the other hand, in the retracted position of the boom arm, a flexible hydraulic line connected at one end to an inner section of the boom arm is connected at its other end to a connector located at the front end of one of the outer sections. Moving the second connection of the flexible line to a point further forwards on the boom arm allows the flexible line to be stored in a channel defined between two of the sections of the boom arm in its retraced condition.

The invention can be applied to a boom arm having three or four sections. When the boom arm has four sections, it is preferable to mount two hydraulic double acting cylinders on the third section one having a piston rod connected to the second section and the other a piston rod connected to the fourth section, the second section being moved relative to the first by means of a double acting cylinder located outside the boom arm. When the boom arm has fewer than four sections, it is possible to dispense with the external hydraulic cylinder, whereupon two cylinders may be mounted on the second section with their piston rods connected to the first and third sections, respectively. In both cases, the channel to accommodate the flexible hydraulic lines leading to the moving cylinders is conveniently located between the outer wall of the second section and the inner wall of the first section.

Preferably, a space between the first and second sections of the boom arm is divided by partitions into separate channels each only wide enough to receive one pair of flexible hydraulic lines.

The portion of each flexible hydraulic line that moves when the boom arm is extended or retracted will always comprise runs separated by a U-bend regardless of the degree of extension of the boom arm. All that happens when the sections of the boom arm move relative to one another is that the ratio of the length of the two runs will change. In other words, the U-bend will move with the moving section (but at half its rate) and one run will become longer as the other becomes shorter. The flexible line is merely unfurled from the channel and it is not dragged relative to the inner wall of any of the sections.

It is further preferred for the section of the boom arm carrying the cylinders to carry rigid tubes each connected at its rear end to a flexible hydraulic line accommodated in a channel defined between the first and second sections of the boom arm and at its front end to a flexible line leading to the free end of the boom arm to power an implement or device carried by the boom arm.

The flexible line connected to the front end of each rigid tube may once again suitably have two runs separated by a U-bend accommodated within the last section of the boom arm, that is to say the smallest section at the free end of the boom arm. To avoid entanglement, one of the two runs of each of the hydraulic lines leading to the free end of the boom is preferably stored within a closed channel defined by the last section of the boom arm. Such a channel may conveniently be formed by welding a strip of L-shaped cross section inside the corner of the last section.

The preferred embodiment will now be described further, by way of example, with reference to the accompanying drawings, in which.

Figure 1:
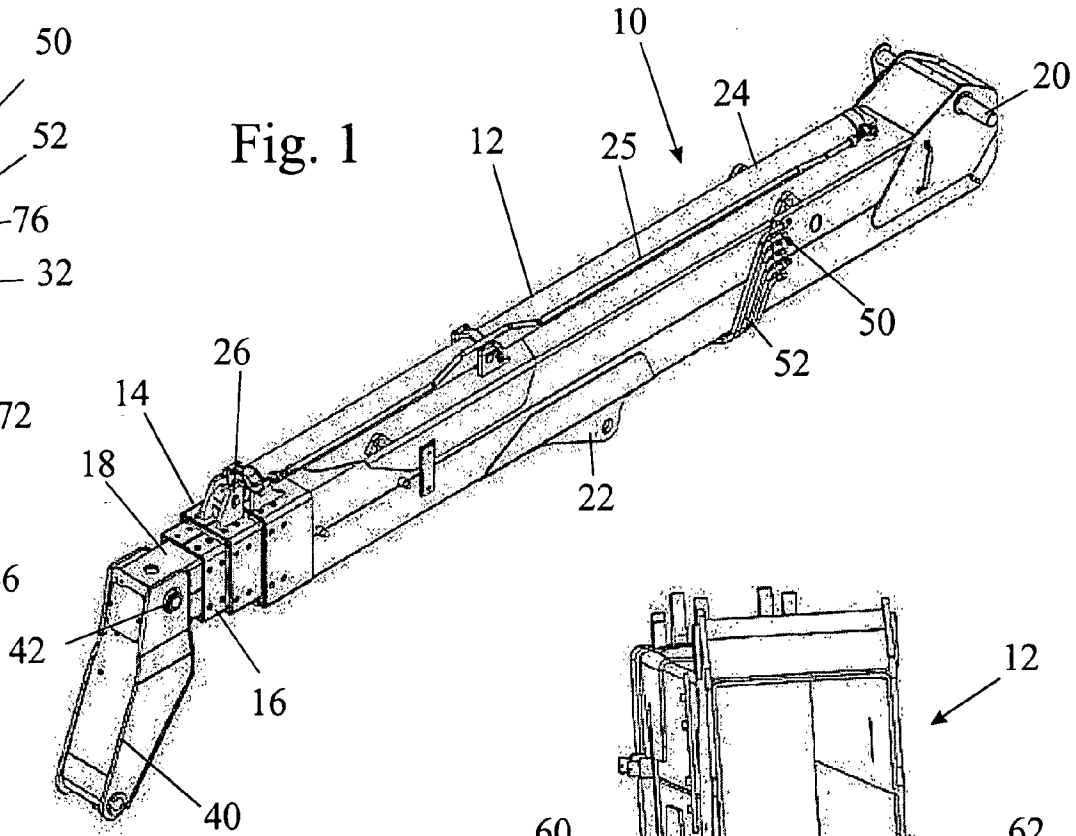
FIG. 1 is a perspective view of a boom arm.

The boom arm 10 shown in the drawings is formed of four telescoped sections or segments designated 12, 14, 16 and 18 respectively. The largest of the sections 12, which is herein termed the first section, has at its rear end a pivot pin 20 by means of which it is pivotably mounted on a vehicle (not shown). On its underside, the first section 12 has a bracket 22 for connection to a hydraulic cylinder (not shown) that acts between the body of the vehicle and the first section 12, to raise and lower the boom arm 10 by pivoting it about the pin 20.

A cylinder 24 is mounted above the first section 12 and its piston rod is connected by a pin 26 to the second section 14. The cylinder 24 is used to move the second section 14 of the boom arm 10 relative to the first.

Figure 3:
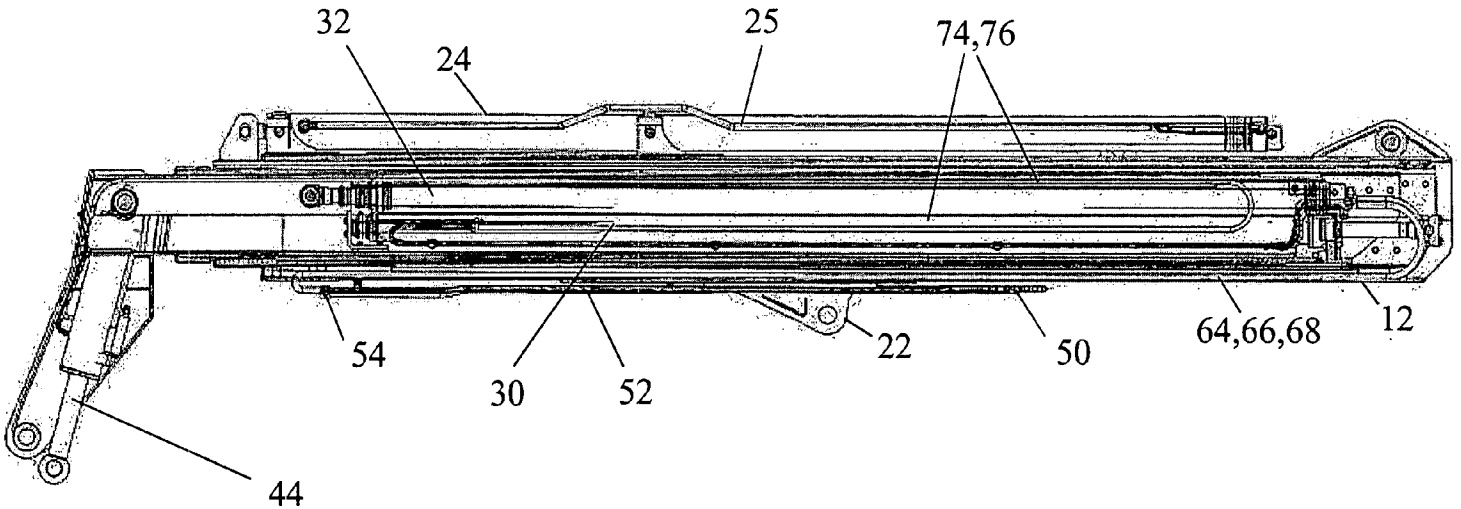
FIG. 3 is a longitudinal section through the boom arm of FIG. 2.
Figure 4:
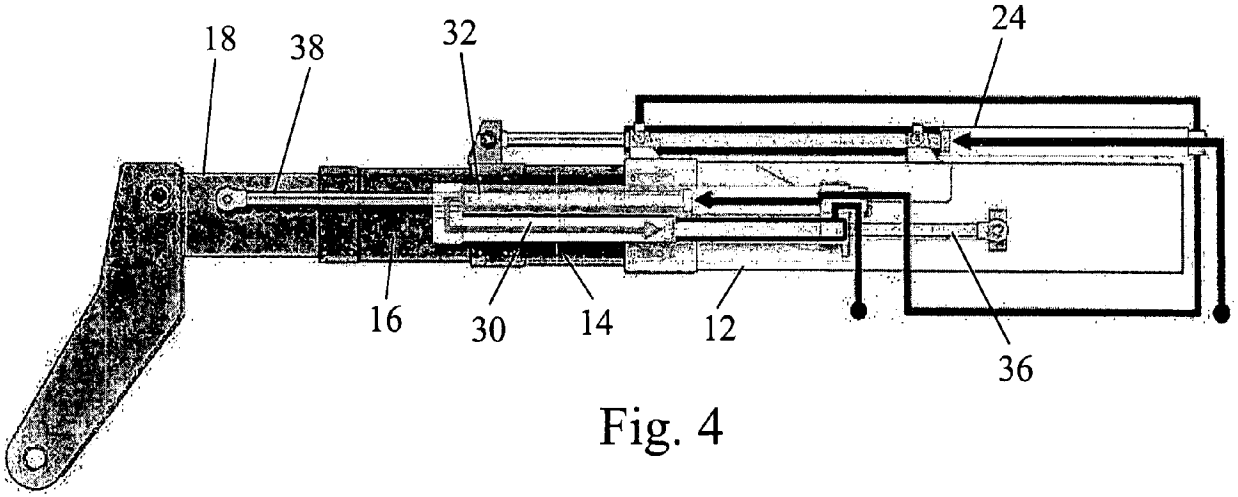
FIG. 4 is a schematic representation of the hydraulic circuit of the boom arm in FIG. 3.
Figure 5:
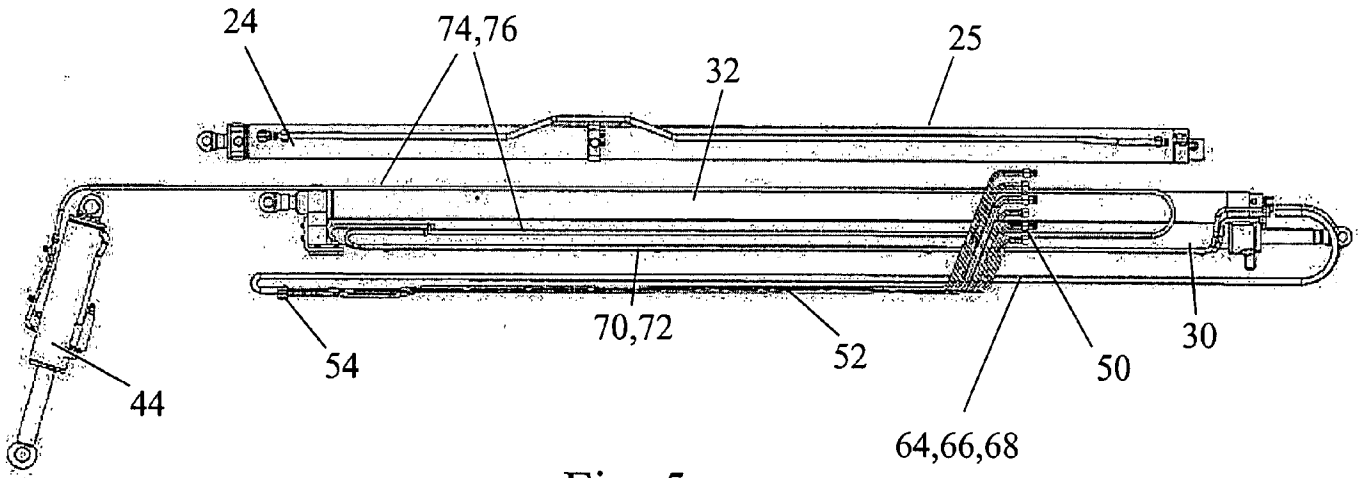
FIG. 5 is a view similar to that of FIG. 3 with the sections of the boom arm concealed to show only the hydraulics.

As is most clearly seen from the schematic representation of FIG. 4, two further cylinders 30 and 32 are connected for movement with the third section 16. In the retracted state of the boom arm 10 shown in FIG. 3, the cylinders 30 and 32 are within the fourth section 18. The end of the piston rod 36 of the cylinder 30 is connected to the second section 14, whereas the piston rod 38 of the cylinder 32 is connected to the fourth section 18.

The cylinders 24, 30 and 32 are all double acting and their working chambers are all connected in series, as shown in FIG. 4, so that all sections of the boom arm 10 move in unison. In order that the sections should move relative to one another by equal amounts, the areas of the working chambers are progressively reduced to compensate for the diameters of the various piston rods.

Thus to extend the boom arm, a pump (not shown) draws hydraulic fluid from a reservoir and supplies it to the chamber to the right of the piston of the cylinder 24, as viewed. This causes the piston rod of the cylinder 24 to move to the left and thereby extend the second section 14. The hydraulic fluid from the second working chamber of the cylinder 24 flows to the first working chamber of the cylinder 32 and extends the fourth section 18 relative to the third section 16. In turn, the fluid from the second working chamber of the cylinder 32 flows through an internal connection to the first working chamber of the cylinder 30 and extends the third section 16 relative to the second section 14. The fluid discharged from the second working chamber of the cylinder 30 is returned to the reservoir from which fluid is drawn by the pump.

The pump and reservoir are connected to the cylinders 24 and 30 through a cross-over valve (not shown) allowing the pump to supply fluid to the cylinder 30 in order to retract the boom arm 10.

The free end of the boom arm 10 carries an implement which may be a lifting fork. The illustrated implement, 40 may for example be a bucket or shovel that is mounted on an arm 40 pivotable relative to the boom arm 10 about a pivot pin 42. The actuator for the implement 40 is a further tilt cylinder 44 to which hydraulic fluid needs to be supplied.

It is therefore necessary to provide hydraulic fluid through flexible lines to the cylinders 30 and 32 mounted on the third section 16 of the boom arm as well to the hydraulic jack 44 mounted on the free end of the boom arm. Further auxiliary hydraulic lines may be required to operate a device at the free end of the boom arm. For example, a hydraulically operated load lock device may be provided to lock the load to safeguard against failure of the hydraulic lines leading to the tilt cylinder. All these flexible lines have hitherto either been located outside the boom arm or else they have been guided to run up the center of the boom arm.

In the described preferred embodiment of the invention, the hydraulic lines leading to and from the cylinders 30 and 32 as well as the lines of the tilt cylinder 44 and the auxiliary lines, are all contained within the boom arm 10. There are six connectors 50 that are located on one side of the boom arm 10 connected by rigid pipes 52 to connectors 54 arranged near the front end of the first section 12.

Externally, a first flexible hydraulic line is connected directly to the cylinder 24. The fluid from the other end of the cylinder 24 flows through a rigid external pipe 25 back to a connecting block at the rear end of the first section and from there the fluid is supplied by either a flexible or a rigid line to one of the connectors 50. The other five flexible lines connected to the connectors 50 are the return line from the cylinders 30 and 32, the two lines leading to the tilt cylinder 44 and the two auxiliary lines.

Figure 7:
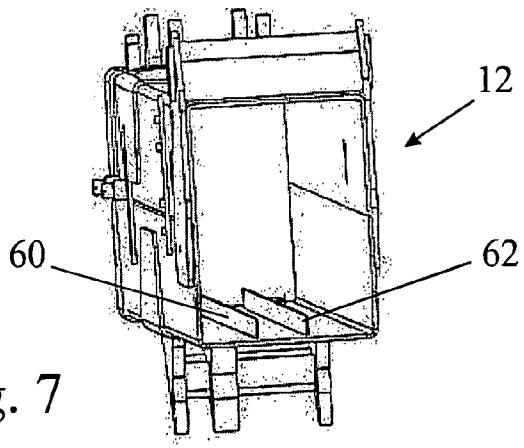
FIG. 7 is a perspective of the first section of the boom arm.
Figure 6:
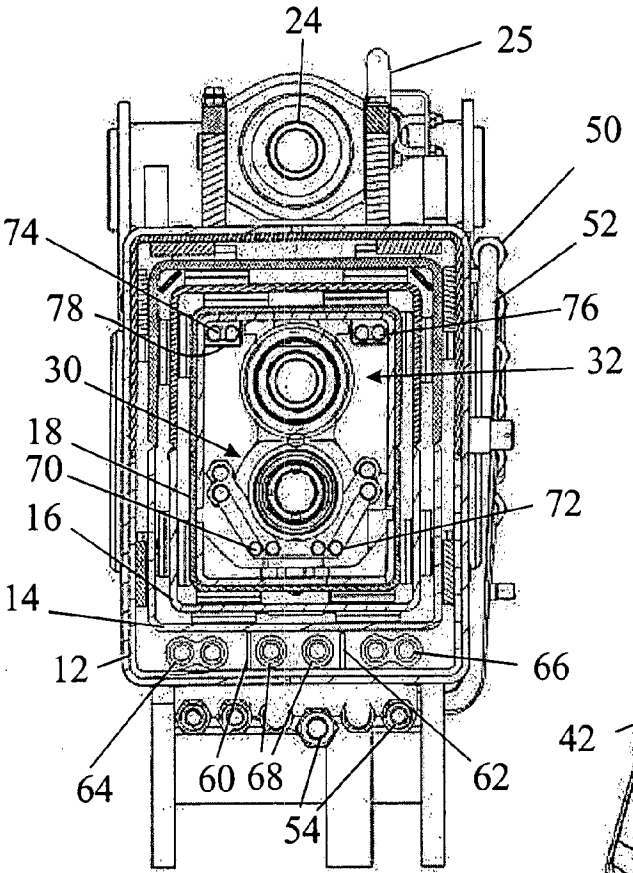
FIG. 6 is a section along the plate VI-VI in FIG. 3.
Figure 2:
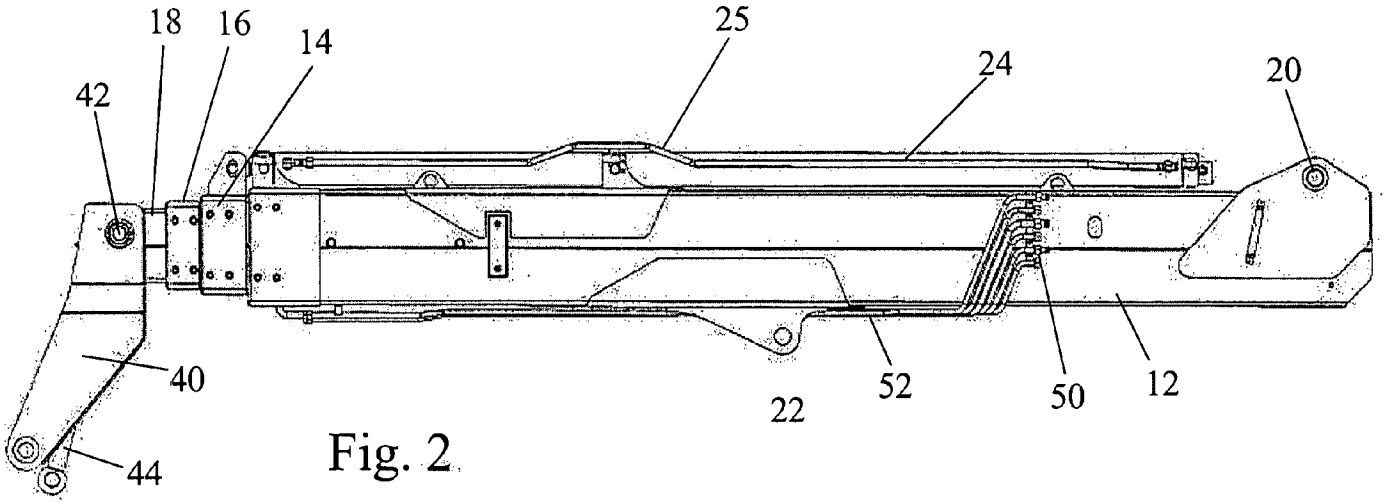
FIG. 2 is a side view of the boom arm in FIG. 1.

As best shown in FIGS. 6 and 7, the first section 12 is made significantly larger than the second section 14 to leave a space between the two beneath the second section 14 which is divided by upright partition walls 60 and 62 into three separate longitudinal channels. The pairs of flexible hydraulic lines 64, 66 and 68 (see FIG. 6) are coupled to the connectors 54 and these pass each along a respective one of the three channels to the rear end of the third section 16.

The paired hydraulic lines 64, 66 and 68 are joined to one another over most of their length and each channel is wide enough to accommodate only one pair of hydraulic lines. The flexible lines therefore simply rest as straight runs in these channels.

The lines 68 after making a U-turn at the rear end of the boom arm, are connected to the hydraulic cylinders 30 and 32. When the boom are is extended, the end of the lines 68 moves with the third section 16 and the U-bend moves at half the rate of the third section 16, in other words at the rate of the second section 14. The run of the lines 68 in the channel is always covered from above by the second section 14, which closes the channel. There is therefore no possibility of the lines 68 coming out of their channel. As the sections of the boom arm move relative to one another, the lines 66 always lie as two runs separated by a U-bend with one run encased in a channel and the other located inside the second section 14. As the sections move relative to another the U-bend moves to shorten one of the runs and lengthen the other.

The other two pairs of flexible lines 64 and 66 are unfurled from their channels in the same way but at their other ends they are connected to two rigid pairs of pipes 70 and 72 that are mounted beneath the cylinders 30 and 21 for movement with the third section 16 of the boom arm. This brings the hydraulic connections required by the lines of the tilt 44 and the auxiliary lines to the front end of the third section 16 of the boom arm. Two further pairs of flexible lines 74 and 76, that lie in a U-shape in the fourth section 18, lead from the connectors of the rigid pipes 70 and 72 to the free end of the boom arm 10. The upper run of each of the pairs of flexible lines 74, 76 is housed in a closed channel in an upper corner of the fourth section, the channel being formed welding a strip 78 of L-shaped cross section within the corner of the section 18. There is therefore only run of each pair that is capable of bending and this once again moves in the same as the flexible lines 64, 66 and 68. The free runs of the pairs of flexible lines are confined laterally between the cylinders 30, 32 and the sides of the fourth section 18 and this once again constrains the movement of the flexible lines preventing them from becoming entangled.

As the invention is concerned with the layout of the hydraulic lines, it has not been deemed necessary to describe in details some of the parts illustrated in the drawings, which show for example the manner in which the sections are supported and guided for movement relative to one another.

Such features are already known and will be readily understood by the person skilled in the art.

It will be appreciated that the invention is applicable to boom arms having other than four sections. For example, a boom arm with three sections can be constructed in the same manner as the second, third and fourth sections described above, with the omission of the first section and the external cylinder 24. Alternatively, the external cylinder 24 may be retained and only one cylinder need then be mounted on the second of the sections to extend the third section.

The invention claimed is:

1. A telescopic boom arm operable between a retracted position and an extended position, the telescopic boom arm comprising:

an elongate first boom section comprising top and bottom walls and opposed side walls, the walls defining a first cross section;

an elongate second boom section comprising top and bottom walls and opposed side walls, the walls of the second boom section defining a second cross section, which is smaller than the first cross section, and being dimensioned such that an elongate channel is formed between the bottom walls of the first and second boom sections, the elongate channel having an enclosed length variable by extension and retraction of the second boom section relative to the first boom section, the enclosed length being maximized with the second section is fully retracted and minimized with the second section is fully extended;

at least one partition wall secured to the bottom wall of the first boom section and extending generally perpendicular therefrom toward the bottom wall of the second boom section, the at least one partition wall further extending substantially the length of the elongate channel between the first and second boom sections for dividing the elongate channel into a plurality of separate longitudinal channels, each separate longitudinal channel having sufficient width to receive only two flexible hydraulic lines;

a third boom section and a fourth boom section and a plurality of hydraulic double-acting cylinders mounted on the third boom section, one cylinder including a piston rod connected to the second boom section and the other cylinder including a piston rod connected to the fourth boom section, the second boom section being moved relative to the first boom section by means of a double-acting cylinder affixed to an outer surface of the top wall of the first boom section; and a first plurality of elongate flexible hydraulic lines, each line of said first plurality being connected via a connector at one end to the bottom wall of the first boom section and partially disposed within the elongate channel, two lines in each longitudinal channel, when the boom arm is in its retracted position, each line being connected at the other end to in respective pairs to the double acting hydraulic cylindrs in the third boom section such that each line comprises two runs separated by a U-bend, one of the two runs being partially disposed in the longitudinal channel, and wherein respective lengths of the two runs varies inversely as the telescopic boom is extended or retracted thereby causing the position of the U-bend to move, as the telescopic boom is moving, along the length of the longitudinal channel at a rate generally equal to a rate of change in the enclosed length.

2. A boom arm according to claim 1, wherein the hydraulic cylinders are fluidly connected in series, whereby the boom sections are moved simultaneously by the hydraulic cylinders.

3. A boom arm as claimed in claim 1, further comprising a plurality of rigid tubes, each connected at one end to a respective one line of the first plurality of flexible hydraulic lines and at its other end to a respective end of a second plurality of flexible lines leading to a distal end of the fourth boom section for powering an implement or device carried by the boom arm.

4. A boom arm according to claim 3, wherein the second plurality of flexible lines connected to the front end of each rigid tube comprises two runs separated by a U-bend disposed within the fourth boom section.

5. A boom arm as claimed in claim 4, wherein one of the two runs of each of the second plurality of hydraulic lines is disposed within a closed channel defined by the fourth boom section.

6. A boom arm as claimed in claim 5, wherein the closed channel comprises a strip of L-shaped cross section inside the corner of the fourth boom section.

* * * * *